US005534083A

United States Patent [19]

Chung et al.

[11] Patent Number: 5,534,083

[45] Date of Patent: Jul. 9, 1996

[54] METHOD FOR PRODUCING A REINFORCING STAINLESS STEEL WIRE-ALUMINUM ALLOY COMPOSITE STRUCTURE AND A PRODUCT THEREOF

[75] Inventors: Bum-Goo Chung, Kyungsangnam-Do; Myung-Ho Kim, Inchun, both of Rep. of Korea

[73] Assignee: Hyundai Motor Co., Ltd., Seoul, Rep. of Korea

[21] Appl. No.: 434,590

[22] Filed: May 4, 1995

[30] Foreign Application Priority Data

May 4, 1994 [KR] Rep. of Korea ..... 94-9782

[51] Int. Cl.[6] ..... C23C 2/12; C23C 8/32

[52] U.S. Cl. ..... 148/218; 428/653; 428/685; 428/607; 428/627; 427/123; 427/405

[58] Field of Search ..... 428/653, 685, 428/607; 427/627, 123, 405; 148/218, 319

[56] References Cited

U.S. PATENT DOCUMENTS 4,624,895 11/1986 Nickola ..... 428/607

FOREIGN PATENT DOCUMENTS 54-41211 4/1979 Japan ..... 428/651
63-42362 2/1988 Japan ..... 428/627

*Primary Examiner*—Deborah Yee
*Attorney, Agent, or Firm*—Birch, Stewart, Kolasch & Birch

[57] ABSTRACT

A method for processing a reinforcing stainless steel wire—aluminum alloy composite structure, includes carbon nitriding the surface of a stainless steel wire and coating the treated stainless steel wire with an aluminum alloy, and a product thereof.

4 Claims, 3 Drawing Sheets

(as-cast)

t = 2 t = 1

(as-cast)

t = 6 t = 3 t = 2

METHOD FOR PRODUCING A REINFORCING STAINLESS STEEL WIRE-ALUMINUM ALLOY COMPOSITE STRUCTURE AND A PRODUCT THEREOF

BACKGROUND OF THE INVENTION

1. Field of the Invention

The present invention relates to a method for producing a reinforcing stainless steel wire—aluminum alloy composite structure and a product thereof and more particularly, to a surface treatment of a reinforcing stainless steel wire with carbon nitride for use in an aluminum alloy composite structure for preventing the reduction in strength of the stainless steel wire.

2. Description of Related Art

Generally, a boundary reaction between a reinforcing fiber and a matrix in a fiber-matrix composite structure influences the mechanical property and the reinforcing effect thereof. Particularly, the wetability between the matrix and the reinforcing fiber critically influences the properties of its composite structure. Since the reactivity of the reinforcing fiber and the aluminum matrix is serious, the precipitation of a secondary phase generated by contact reactions causes a reduction in the mechanical properties.

Also, if the steel wire is used as the reinforcing fiber, the contacting reaction of the steel wire and the aluminum alloy matrix produces brittle $Fe_mAl_n$ compound since the solubility of steel with aluminum is very low such as, for example, 0.01 to 0.12 weight % at 275° to 600° C. Specifically, n-phase $Fe_2Al_5$ layer is produced at the boundary surface of steel and aluminum, and its characteristics diffuses very fast through the vacancy and grows at a high speed at 700° to 750° C.

Generally, an increase of the thickness of the boundary reaction layer causes a decrease in the tensile strength and the fracture elongation of the composite structure. However, if the thickness of the boundary reaction layer is less than 10 μm, it does not influence the cold deformation.

The growth of this metal compound ($Fe_mAl_n$) layer depends on the composition of the aluminum melt and the reinforcing wire. If Si of 2 to 12% is put into the aluminum melt, the growth of this metal compound can be controlled and also if Cr, Ni, Cu, Si, C and $O_2$ is added to the steel composition, the product of $Fe_mAl_n$ compound is controlled. Furthermore, if Mo and W exist the growth of this $Fe_mAl_n$ compound is controlled by the diffusion thereof. Also, if Co electric gilding can be reduced the thickness of this $Fe_mAl_n$ compound.

SUMMARY OF THE INVENTION

Accordingly, it is an object of the present invention to provide a method for producing a reinforcing stainless steel wire—aluminum alloy composite structure and a product thereof, which eliminates the above problems encountered with conventional methods and its product.

Another object of the present invention is to provide an improved method for producing a reinforcing stainless steel wire—aluminum composite structure, which comprises carbon nitriding the surface of a stainless steel wire at a temperature of about 550° C. to 650° C., and coating thus treated stainless steel wire with an aluminum alloy to form the stainless steel wire—aluminum alloy composite structure.

A further object of the present invention is to provide a stainless steel wire—aluminum alloy composite structure which comprises a stainless steel wire coated with an aluminum alloy, the stainless steel wire and the aluminum alloy defining a boundary layer therebetween which represents a carbon nitride treatment of the stainless steel wire, the thickness of the boundary layer being less than 10 μm.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a method for producing a reinforcing stainless steel wire—aluminum alloy composite structure, comprises carbon nitriding the surface of a stainless steel wire with an aluminum alloy, and a product thereof.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
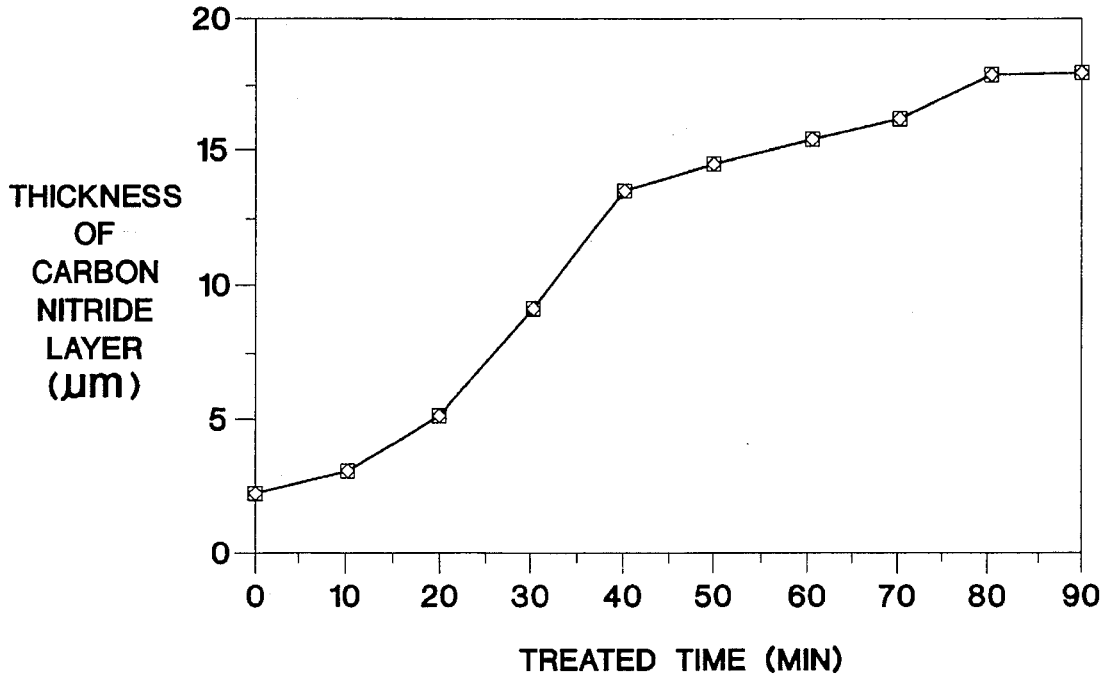
FIG. 1 is a graph showing the change of thickness of carbon nitride depending on treatment time of carbon nitriding treatment of a stainless steel wire according to the present invention.

Referring now in detail to the drawings for the purpose of illustrating the preferred embodiments of the present invention, a method for producing a reinforcing stainless steel wire and aluminum composite structure and the product thereof as shown in FIGS. 1, 2, 3(A), 3(B), 3(C), 3(D), 4, 5(A), 5(B), and 5(C) comprises treating the surface of the reinforcing stainless steel wire with carbon nitride, and coating the treated stainless steel wire with an aluminum alloy to form the reinforcing stainless steel wire—aluminum alloy composite structure. The reinforcing stainless steel wires of the present invention are used in connecting rods and the like.

The surface of the reinforcing stainless steel wire is treated with the carbon nitride at a temperature of about 550° C. to 650° C. for about 5 to 30 minutes. Because the carbon nitriding treatment prevents the formation of a boundary reaction layer between the reinforcing stainless steel wire and the aluminum alloy, the steel wire and the aluminum alloy can form a composite structure at a high temperature which lasts for a long time.

In the carbon nitriding treatment, the formed compound layer is defined as a Fe-N-C series with substantially an ϵ-phase $Fe_3N$ and a γ-phase $Fe_4N$ since the Fe-N-C series has a low N potential. As a matter of fact, at the surface of the carbon nitriding layer, $Fe_2N$ is first produced. Since $Fe_2N$ has a high hardness but an unstable state, $Fe_3N$ and $Fe_4N$ is formed in order.

As the carbon nitriding treatment increases, the thickness of the produced carbon nitriding layer also increases. Also, since the white $Fe_2N$ and ϵ-phase $Fe_3N$ produced at the surface of the carbon nitriding layer is unstable, this white layer of $Fe_2N$ and $Fe_3N$ is converted to γ-phase $Fe_4N$ with a thickness of about 5 μm.

If a treatment temperature of less than 550° C. is utilized, the carbon nitriding layer is not formed, and if the treatment temperature is more than 650° C., only carbon and not much carbon nitride is formed. If the temperature treatment is less than 5 minutes, the carbon nitriding layer does not form, and if over 30 minutes, the thickness of the compound layer becomes too large. Therefore, the carbon nitriding treatment of the present invention is preferably accomplished at a temperature of 550° C.–650° C. and at a period of time of 5–30 minutes.

The coating of the treated reinforcing stainless steel wire utilizes a squeeze casting method in which the stainless steel wire is put into a melted aluminum solution in an electric resistance furnace to produce the reinforcing stainless steel wire and aluminum alloy composite structure. In order to analyze a boundary reactivity, a proper melt treatment and a comparative treatment is necessary.

Accordingly, the method for producing a reinforcing composite product according to the present invention functions to prevent the formation of a boundary reaction layer between the stainless steel wire and aluminum alloy whereby the reinforcing composite product exhibits improved tensile strength and fatigue limitations as well as other mechanical properties thereof.

The present invention will now be described in more detail in connection with the following examples which should be considered as being exemplary and not limiting the present invention.

REFERENCE EXAMPLES

(A) Selection of an Alloy Series of a Reinforcing Fiber and a Matrix

The reinforcing stainless steel wire according to the present invention having the trademark SUS 304 possesses a large quantity of Cr and Ni which produces the properties as shown in the following Table 1.

TABLE 1

| Mechanical properties of stainless steel wire (SUS 304) | | | |
|---|---|---|---|
| | Diameter (μm) | UTS* (Kg/mm$^2$) | tensile ratio (%) |
| SUS 304 | 100 | >200 | 0.8 |

*UTS is the ultimate tensile strength

This selected SUS 304 wire is a drawn micro size stainless steel wire which has a high tensile strength since when the stainless steel wire drawing processes, it does not accompany with the processing hardness, processing construction, and internal link on the surface thereof.

The aluminum alloy AC4D is a high tensile strength ratio alloy having the properties as shown in the following Table 2. This matrix AC4D is used in Japan as a connecting rod composite material.

TABLE 2

| Characteristic properties of aluminum matrix | | |
|---|---|---|
| alloy | UTS (Kg/mm$^2$) | tensile ratio (%) |
| AC4D-T6 | 32 | 8 |

(B) Process of Specimen (a) Process of preform

First of all, the preform for use in a reinforcing product is manufactured by using a net made with stainless steel wire (SUS 304). The wire used to make the net has a diameter of 100 μm and a 100 mesh. The net is manufactured by crossing stainless steel wire SUS 304 at right angles. Two separate nets, A and B, are manufactured. One net A is treated with carbon nitride as one specimen and the other net B is not treated with carbon nitride. The net B is washed by ultrasonic cleaning in an acetone solution so as to prevent its contamination with strange materials.

(b) Process of squeeze casting

Specimen A is manufactured by using a vertical pressure type squeeze casting machine of 50 ton provided by the Korea Institute of Science and Technology (KIST), Seoul, Korea. The process of manufacturing the specimen is as follows. First of all, a preheated metal mold (SKD 60 material) is placed on a supporting plate disposed on the lower portion of the squeeze casting machine. Various types of preforms are fixed to the center of the metal mold and then the temperature of the metal mold is measured by a digital thermometer and a spot thermometer.

When the temperature of the aluminum melt (AC4D) in the electrical resistance furnace reaches a predetermined temperature, the melt is put into the metal mold and the mold is covered. The mold is pressurized at this time, to a pressure of 1500 kg/cm for a period of time of about 30 seconds.

After solidification, the metal mold is removed and the produced specimen is isolated. In order to remove the specimen easily, a conventional coating agent, HOT (graphite material) is previously coated on the internal surface of the metal mold to provide a lubricated internal surface of the metal mold. During the above process, the temperature of the metal mold is maintained at about 250° C. and the temperature of the melt introduced into the mold is about 800° C.

EXAMPLE

Specimens of stainless steel wire SUS 304 having a diameter of 1 mm and a length of 10 cm are put into a carbon nitride furnace. Thereafter the furnace is heated to a temperature of 580° C. and the specimens are removed from the furnace in 10 minute intervals for 90 minutes. During the treatment a flux of ammonia gas at 170 FH and a flux of propane gas at 110 FH is utilized.

Figure 2:
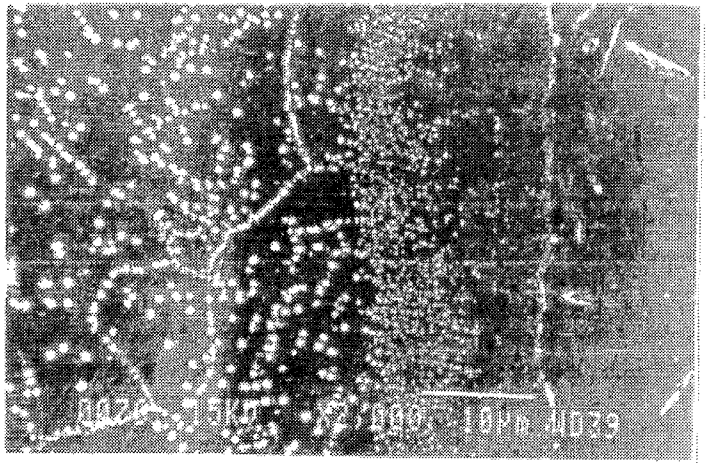
FIG. 2 is a microscope photograph of 2,000 magnifications of a carbon nitriding treated product according to the present invention.
Figure 3B:
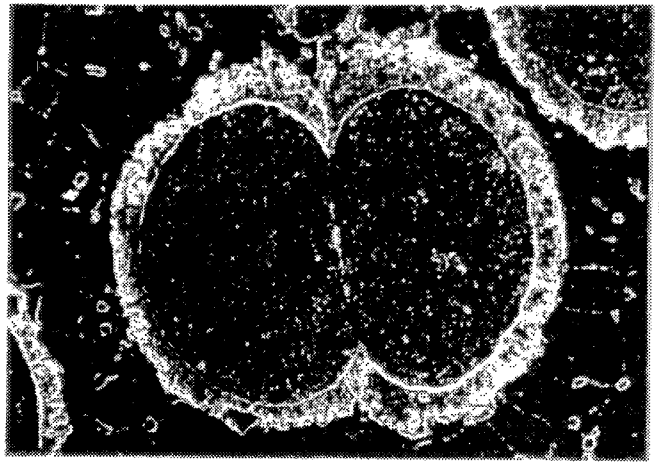

In the study of structure of the carbon nitriding treated specimen, the change of thickness of the carbon nitriding layer according to the treated time is shown in FIG. 1 and the photograph of the structure of the carbon nitriding treated layer is shown in FIG. 2.

As shown in FIG. 1, when the treated time is within 30 minutes, the thickness of carbon nitride layer is under 10 μm, whereby the thickness of the boundary reaction layer FemAln is under 10 μm. Therefore, an aluminum composite structure product having good properties can be produced.

Experimental Example

In order to study the boundary reactivity of the stainless steel wire SUS 304 as a reinforcing preform and the aluminum alloy as a matrix, squeeze casted specimens are melt treatment in a comparative analysis.

First of all, the melting treatment is completed by a T6 treatment condition of the aluminum alloy. That is, the used electrical resistance furnace is heated at a temperature of 525° C. in 1 hour intervals for 6 hours and is cooled down in a cold water.

Secondary, the comparative treatment is heated at a temperature of 525° C. in 30 minute intervals for 10 hours and is cooled down in a cold air.

In these heat treatments, the change of thickness of the boundary reaction layer, which shows the reactivity of the reinforcing wire and the matrix, is measured by a microscope having large, multiple magnifications.

FIGS. 3(A), 3(B), 3(C), and 3(D) show microscope photographs of 400 magnifications of the change of the alloy reaction layer between the reinforcing wire and the matrix according to the treated time when the reinforcing wire is melted without the carbon nitriding treatment.

Figure 4:
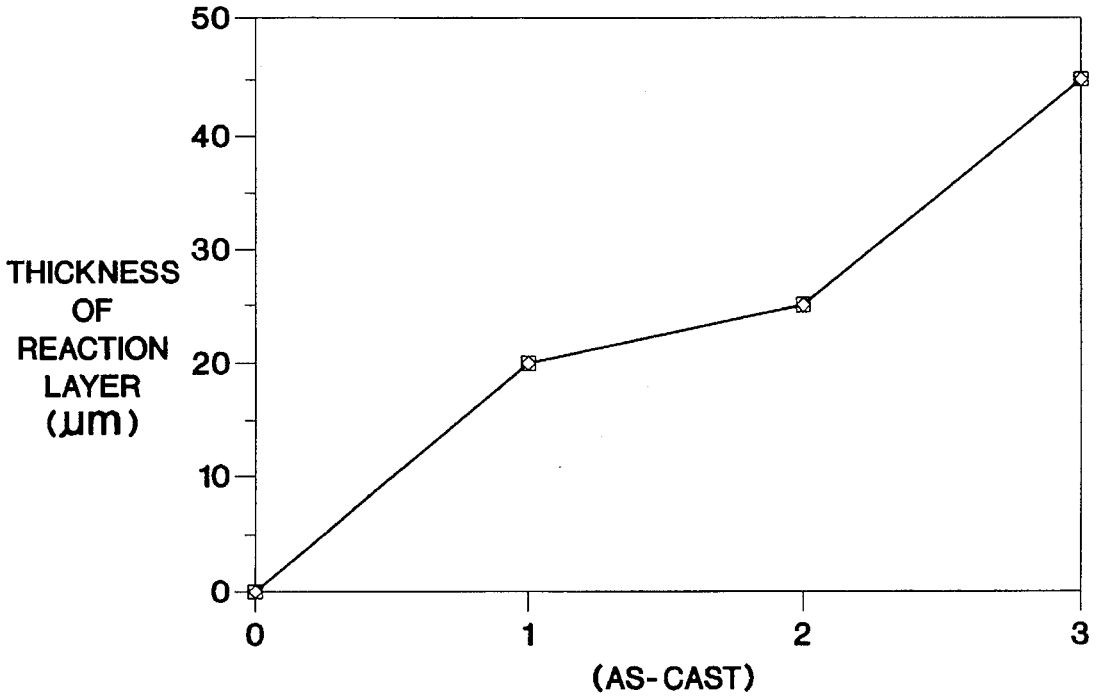
FIG. 4 is a graph showing the changes of the growing state of thickness of the alloy reaction layer according to a time when the reinforcing wire is melted without the carbon nitriding treatment of the present invention.
Figure 3A:
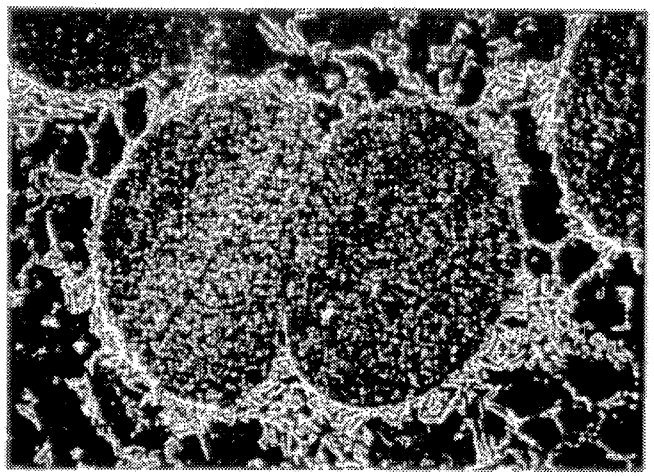
FIGS. 3(A), 3(B), 3(C), and 3(D) are microscope photographs of 400 magnifications of the change of an alloy reaction layer between a reinforcing wire and a matrix according to a treated time when the reinforcing wire is melted without the carbon nitriding treatment of the present invention.
Figure 3C:
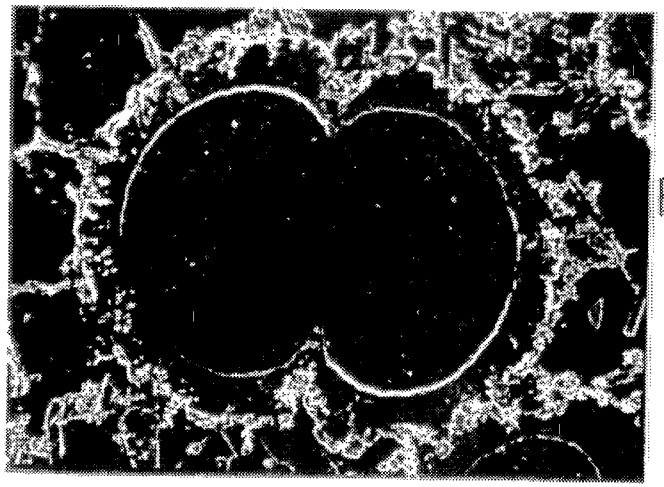

FIG. 4 shows the change of the growing state of thickness of the alloy reaction layer of FIGS. 3(A), 3(B), 3(C), and 3(D).

As shown in FIGS. 3(A), 3(B), 3(C), and 3(D), and 4, the stainless steel wire without carbon nitriding treatment has a very lower reaction layer with the matrix at the as-cast. Furthermore, the stainless steel wire without carbon nitriding treatment has over 10 μm of the thickness of the reaction layer in the melt treatment in over 3 hours in order to improve the mechanical properties of the matrix. Therefore, the stainless steel wire has a lower mechanical properties and falls off in tensile and fatigue properties.

Figure 5A:
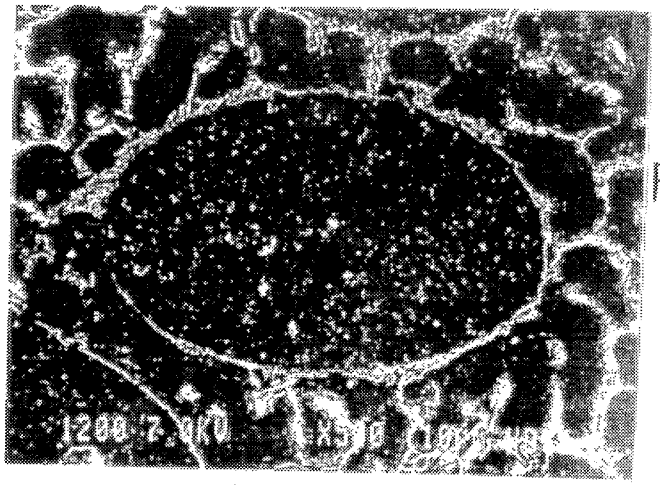
FIGS. 5(A), 5(B), and 5(C) are a microscope photograph of 500 magnifications of the alloy reaction layer depending on a time when the reinforcing wire is melted after the carbon nitriding treatment according to the present invention.
Figure 5C:
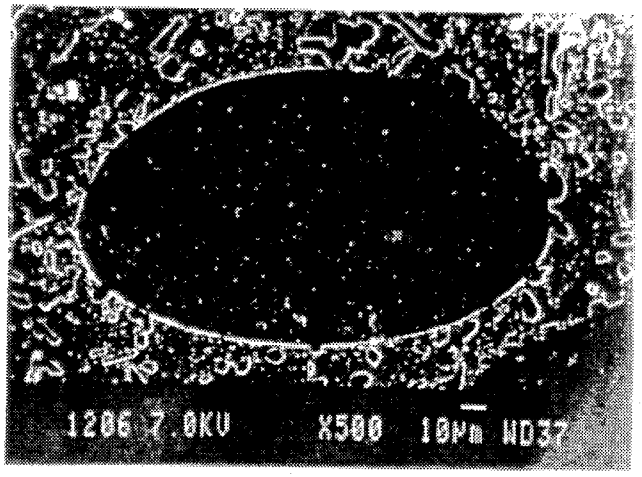
Figure 3D:
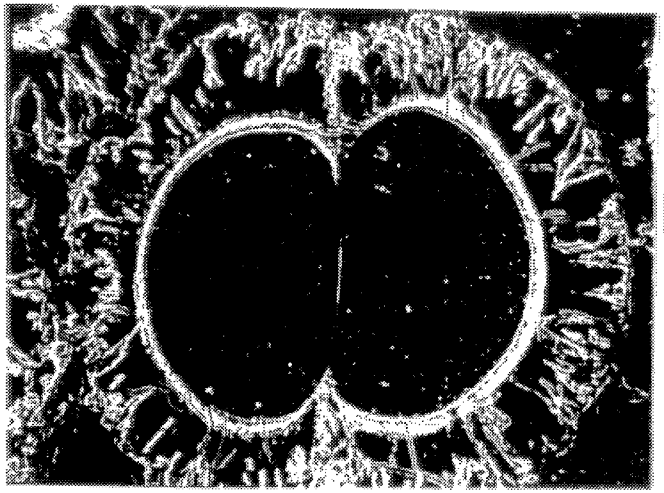
Figure 5B:
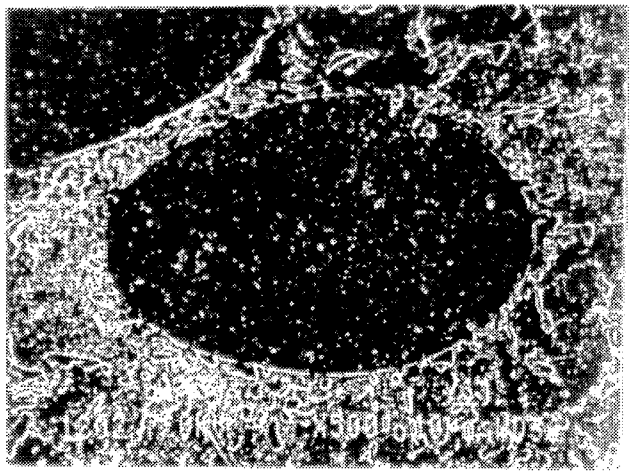

However, as shown in FIGS. 5(A), 5(B), and 5(C), the stainless steel wire having the carbon nitriding treatment according to the present invention does not grow the reaction layer after the melt treatment for 6 hours. Because the addition of carbon and nitrogen around the surface of the stainless steel wire reduces the diffusion speed of aluminum atom, it controls the growth of the $Fe_2Al_5$ phase.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a reinforcing stainless steel wire—aluminum alloy composite structure, which comprises:

carbon nitriding the surface of a stainless steel wire at a temperature of about 550° C. to 650° C., and coating the thus treated stainless steel wire with an aluminum alloy to form the stainless steel wire aluminum alloy composite structure.

2. The method of claim 1 wherein the carbon nitriding treatment is conducted for a period of 5 to 30 minutes.

3. A stainless steel wire—aluminum alloy composite structure which comprises:

stainless steel wire coated with an aluminum alloy, said stainless steel and said aluminum alloy defining a boundary layer therebetween which represents a carbon nitride treatment of said stainless steel wire.

4. The stainless steel wire composite structure of claim 3 wherein the thickness of said boundary layer is less than 10 μm.

* * * * *